United States Patent [19]

Mattison

[11] 4,170,046

[45] Oct. 9, 1979

[54] FOOT LIQUID DISPENSER

[75] Inventor: Grant G. Mattison, Redwood City, Calif.

[73] Assignee: Jones-Hamilton Co., Newark, Calif.

[21] Appl. No.: 930,910

[22] Filed: Aug. 4, 1978

[51] Int. Cl.[2] ..... A47K 5/12

[52] U.S. Cl. ..... 4/182; 222/179

[58] Field of Search ..... 4/182, 155, 156, 147; 222/179, 186, 265, 275

[56] References Cited

U.S. PATENT DOCUMENTS

| | | | |
|---|---|---|---|
| 2,988,754 | 6/1961 | Misson | 4/182 |
| 3,233,787 | 2/1966 | Ross | 222/179 |

*Primary Examiner*—Lenard A. Footland

*Attorney, Agent, or Firm*—Lothrop & West

[57] ABSTRACT

A foot liquid dispenser has a liquid reservoir on a base. A liquid sprayer on the base is connected to the reservoir and is mounted to discharge at a predetermined height above the base and in a predetermined direction. The sprayer is operated by a lever actuated by a bail pivoted on the base and having a small transverse bar projecting beyond the base and engageable by the user's foot. The bar is pivoted to travel from an upper position substantially above the spray then through the spray to a lower position substantially below the spray so the user's foot in depressing the bar is sprayed both bottom and top and excess liquid falls free of the dispenser.

9 Claims, 3 Drawing Figures

FOOT LIQUID DISPENSER

BRIEF SUMMARY OF THE INVENTION

For use in conditioning a person's feet against some detrimental conditions, it is often useful to employ a liquid containing additives. As an improved manner and an improved means for dispensing such liquid, there is provided a reservoir for the liquid mounted on a base and connected to a sprayer mounted to discharge generally horizontally at a substantial height above a floor on which the base rests. The sprayer is actuated by a bail pivoted on the base and projecting well beyond the base and is spring-pressed normally to an upper position. A transverse bar on the bail in the upper position is at a substantial distance above the normal, horizontal spray trajectory. The bar is small to mask only a small part of the user's foot and when depressed by the user's foot travels from an upper position in which the bottom portion of the foot is sprayed, then downwardly through the spray to a lower position in which the upper portion of the foot is sprayed. When the user's foot is removed from the transverse bar, the bar is spring returned to the uppermost position for reuse.

DETAILED DESCRIPTION

Figures 1, 2:
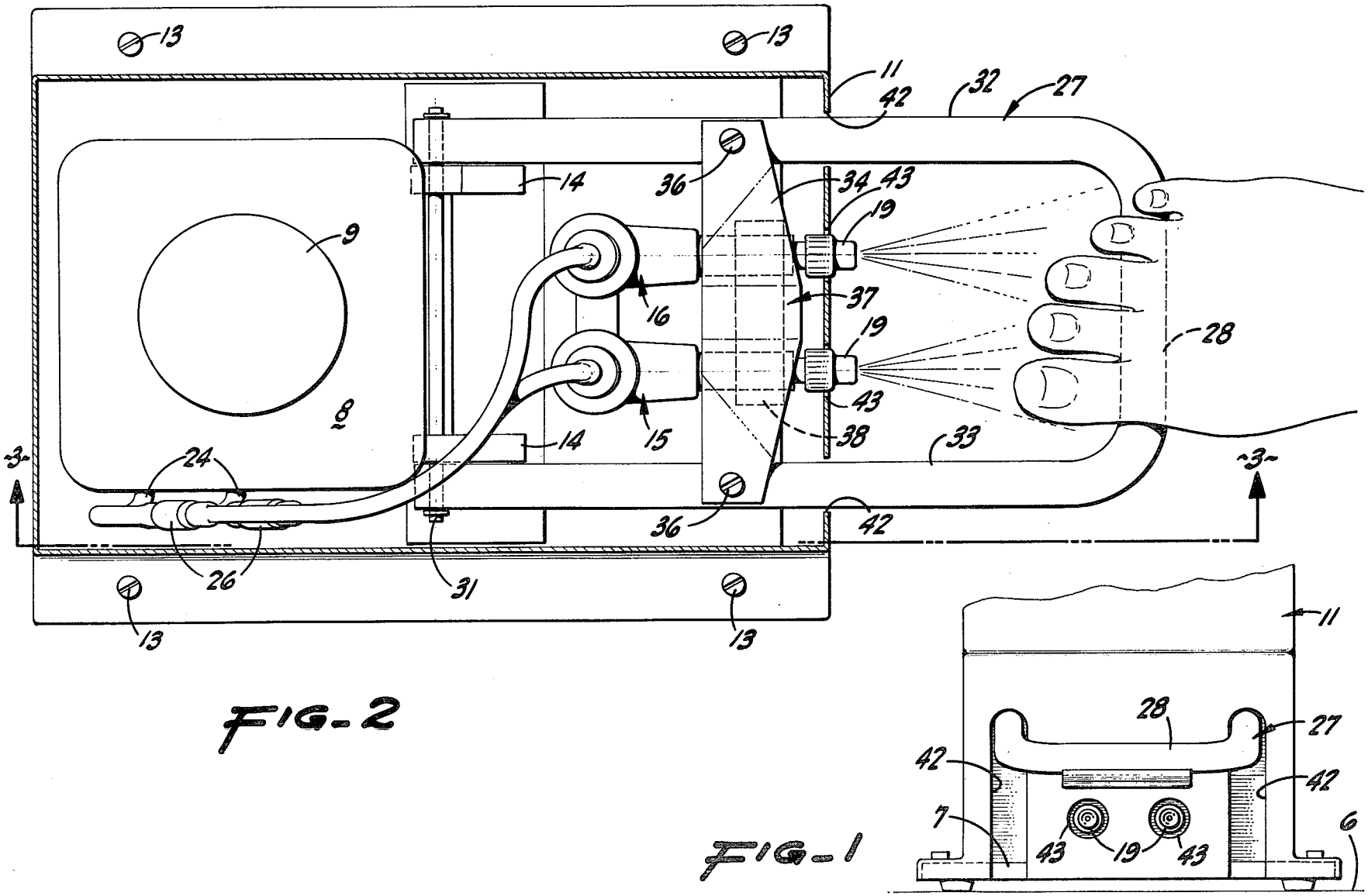
FIG. 1 is a front elevation of a foot liquid dispenser pursuant to the invention with an enclosing cover in place.
FIG. 2 is a plan, to an enlarged scale, of the device of FIG. 1 but with the cover removed.
Figure 3:
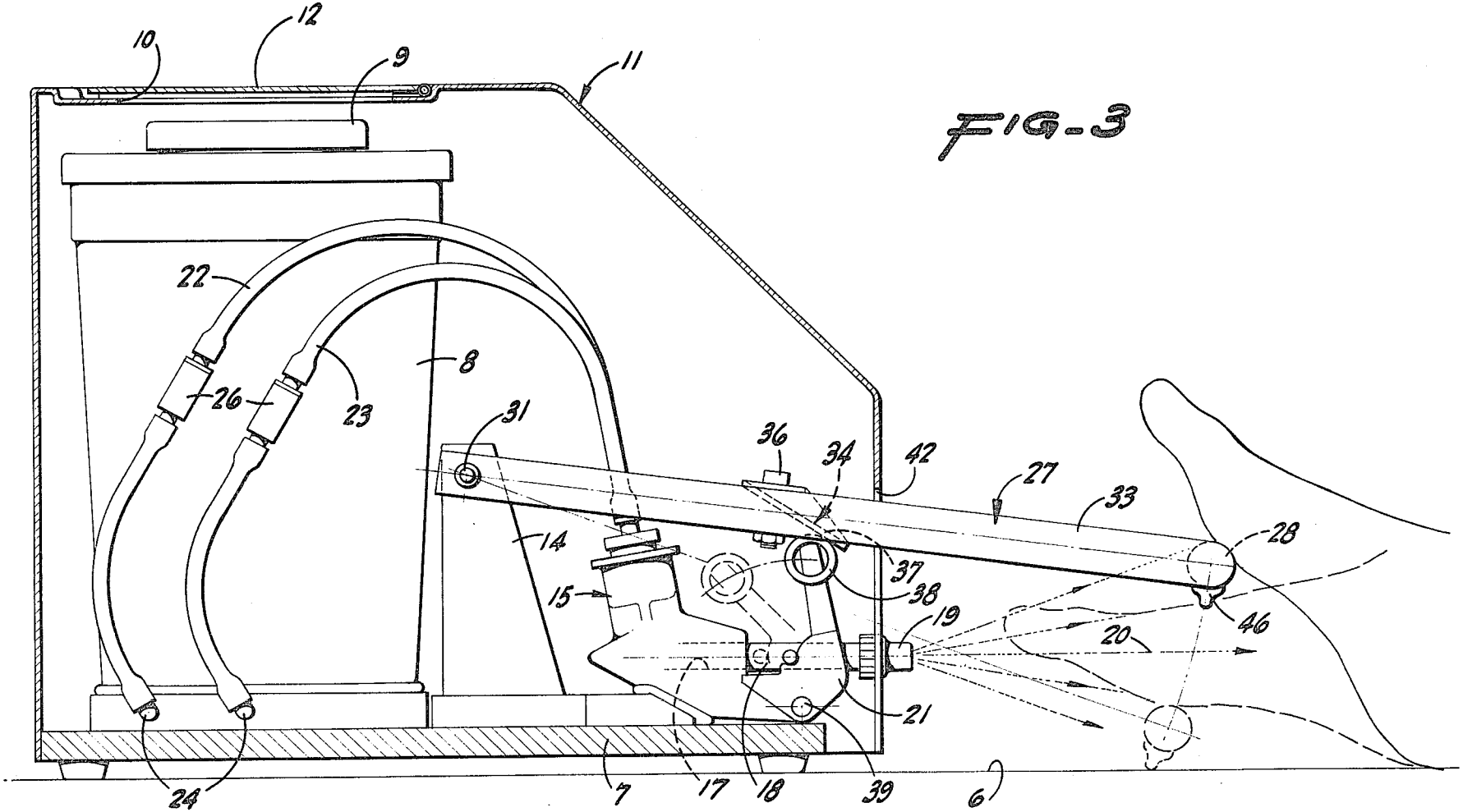
FIG. 3 is a side elevation of the structure with the cover removed, the plane of the view being indicated by the line 3—3 of FIG. 2.

The foot liquid dispenser is often utilized in connection with gymnastic activities, swimming activities or other athletic affairs, although it can be installed in any convenient location. Devices of this general sort have been used for some time. An example is shown in the Misson U.S. Pat. No. 2,988,754, assigned to the assignee hereof, to which reference is made for additional background information. The present device is an improvement over the device of the Misson patent in that the present device affords more thorough liquid application, remains in neater condition, and appears to most people to be easier to use.

A typical environment of use is in a location where there is a floor 6 of a relatively impervious construction that can withstand the liquid utilized and from which extra, dispensed liquid can drain away easily. Disposed on the floor 6 is a base plate 7 on which is mounted a reservoir 8 for the liquid to be dispensed. The reservoir has a removable top 9 accessible through an opening 10 in a cover 11 when a spring-closed swinging door 12 is lifted aside. Conveniently, the cover 11 is removably secured to the base 7 by corner fasteners 13 and serves generally as an enclosure and protector for the mechanism but can easily be taken off for cleaning and servicing.

Likewise mounted on the base plate 7 is a pedestal 14 extending upwardly to a convenient height. Just in front of the pedestal 14 a sprayer 15 is located and is fastened to the base plate 7. It is entirely possible to use only one sprayer 15 but there is some preference for at least two sprayers. The multiple sprayers, when used, substantially duplicate each other so the description is intended to apply to one or more sprayers. In this instance there is a second liquid sprayer 16 arranged on the base 7 alongside the sprayer 15. Each of the sprayers is a convenient, standard unit having a chamber 17 of a cylindrical nature in which a tubular piston 18 is reciprocable against a strong spring, not shown. At rest, the sprayer piston tube 18 is loaded and is in projected position, as shown.

The piston tube 18 terminates in a spray nozzle 19 effective, when actuated, to release a conical spray about an axis disposed in the general direction indicated by the arrow 20 and at a predetermined height above the floor 6 or the base. The spray is actuated or discharged when the nozzle 19 and the tube 18 are impelled by a lever 21 into the chamber 17 against the force of the spring therein. There is a check valve (not shown) within the spray tube 18 effective to block air flow into the spray tube.

Each of the sprayers 15 and 16 is connected by its own individual tube 22 and 23 to one of a pair of elbows 24 opening into the interior of the reservoir 8. So that the mechanism will be effective to pump, each of the tubes 22 and 23 carries a check valve 26 allowing flow from the reservoir to the chambers 17 but precluding back flow.

In order to actuate the liquid sprayers, there is mounted on the base 7 a bail 27. This conveniently is a circular tube of plastic material bent into substantially a U-shape and affording a central, transverse bar 28 a little longer than the usual foot width and projecting beyond or overhanging the base 7 by a substantial distance. The bail 27 is directly above the floor 6 and is mounted on the pedestal 14 by a cross shaft 31 establishing a pivot axis. Spanning the side members 32 and 33 of the bail is a cam plate 34 having ends secured to the bail by fasteners 36 and particularly having a central, inclined portion 37 bearing against a cam follower tube 38. The trigger levers 21 of the sprayers 15 and 16 have pivots 39 on a common axis and supporting the levers on the liquid sprayers.

For the operation of the device, the reservoir 8 is charged with an appropriate foot liquid and the cover 11 is in position. The bail arms or side members 32 and 33 extend forwardly through vertical slots 42 in the front part of the cover. Also, the cover is cut away to provide openings 43 through which the nozzles can discharge. With the device in operating condition, the user puts the ball of one of his feet on the transverse bar 28 and forces the bar downwardly toward the floor 6. This is distinct from the earlier Misson device in which both feet are simultaneously employed. That movement begins with the bottom of his foot substantially above the axis line or arrow 20 of the spray and in an upper position even above the envelope of the spray. Again, this is distinct from the Misson device in which the beginning of the spray is with the user's foot virtually below the spray axis. The bar 28 is of relatively small diameter so that even though it is comfortable, it does not block or obscure any material part of the bottom of the user's foot, the bar preferably being round to be as unobstructive as possible. The ribs of the treadles in Misson cover about half of the foot bottom.

As the user depresses the cross bar 28 and so rotates the bail downwardly about the cross shaft pivot 31, the inclined portion or cam 37 pushes against the cam follower tube 38 and rocks the spray nozzle levers 21 about the pivot 39. This motion causes the nozzles 19 to retract against their springs, the opening of the discharge check valves and the closure of the intake check valves 26. As the spray tubes 18 retract into the chambers 17, appropriate conical sprays issue from both of the nozzles in the general direction 20 and spray against the user's foot. As the user continues to depress the bail, his foot travels downwardly through the twin sprays and finally approaches a lowermost position. At a suitable height above the floor 6, the cross bar 28 is appropriately stopped by a floor-contacting lug 46 on the bottom of the transverse portion 28. This not only terminates the spray, the latter part of which has covered the upper portion of the user's foot, but likewise takes the force from the bail before the spray pistons 18 bottom. When the lug 46 is in contact with the floor 6 there is no tendency, despite the long overhand of the bail from the base 7 and even though the pistons 18 may be bottomed, to tip or upset the base.

When he has reached the lowermost position, the user withdraws his foot from the cross bar 28 of the bail. The springs in the nozzles then recharge the nozzles and restore the bail to its uppermost position. The user then shifts his weight to his sprayed foot and again goes through the spraying motion but with the previously unsprayed foot. The action is substantially a duplicate of that just described. His foot being treated first receives direct spray on the bottom then travels generally through the spray to be well coated all over and finally is directly sprayed on the top. In this fashion an adequate amount of foot liquid is dispensed evenly over substantially all of the user's foot, particularly all over the toe portions wherein difficulty often resides.

The spray which does not adhere to the user's foot or feet simply falls by gravity onto the floor 6 without substantially contaminating or touching the base 7 and simply runs off to drain. In this way the unit itself is left generally free of spray, although the cross bar 28 is continually coated with the treatment liquid. Also liquid is renewed on the floor 6 in the area beyond the base 6 and on which the user stands. There has thus been provided a foot liquid dispenser easily utilized by anyone and effective to provide a thorough top and bottom spray coat of material over the user's foot, which is left largely exposed for the reception of the treatment liquid; but the dispenser is left reasonably free of spray liquid and in a virtually dry, acceptable condition except for the actuating, transverse bar which, advantageously, can be repeatedly sprayed.

I claim:

1. A foot liquid dispenser comprising a base, a liquid reservoir on said base, a liquid sprayer mounted on said base to discharge at a predetermined height above said base and in a predetermined direction, means for connecting said sprayer to said reservoir, a lever for operating said sprayer, a bail having a pair of spaced-apart side arms connected by a transverse bar, means for pivoting said side arms on said base on opposite sides of said sprayer and for rotation about a transverse axis normal to said direction and parallel to said bar and with said bar disposed beyond said sprayer and movable between an upper position above predetermined height and a lower position below said predetermined height, and means interconnecting said bail and said lever.

2. A device as in claim 1 including an additional liquid sprayer having a second lever for the operation thereof, means mounting said additional sprayer on said base alongside said liquid sprayer, means for connecting said additional liquid sprayer to said reservoir, and means interconnecting said bail and said second lever.

3. A device as in claim 1 in which said base is adapted to rest on a floor, and means on said bail engageable with said floor for limiting movement of said bail toward said floor.

4. A device as in claim 3 in which said bail extends beyond said base.

5. A device as in claim 1 in which said interconnecting means is a cam on said bail adapted to abut a cam follower on said lever.

6. A device as in claim 1 in which said bail comprises a tube circular in transverse cross-section and of U-shape configuration.

7. A device as in claim 1 in which a user's foot in depressing said bail moves from an upper position substantially above said predetermined height and in a path across said predetermined direction to a lower position substantially below said predetermined height.

8. A device as in claim 1 including means for urging said bar toward said upper position.

9. A device as in claim 8 in which said urging means is a spring in said liquid sprayer.

* * * * *